US006350070B1

(12) United States Patent
Tasma

(10) Patent No.: US 6,350,070 B1
(45) Date of Patent: Feb. 26, 2002

(54) LABEL PRINTER/APPLICATOR WITH ADJUSTABLE, FLOATING PRINT HEAD

(75) Inventor: Gerald Wayne Tasma, Cedar Springs, MI (US)

(73) Assignee: Grand Rapids Label Company, Grand Rapids, MI (US)

( * ) Notice: Subject to any disclaimer, the term of this patent is extended or adjusted under 35 U.S.C. 154(b) by 0 days.

(21) Appl. No.: 09/543,643

(22) Filed: Apr. 6, 2000

Related U.S. Application Data

(60) Provisional application No. 60/128,896, filed on Apr. 12, 1999.

(51) Int. Cl.[7] ..... B41J 11/20

(52) U.S. Cl. ..... 400/55; 400/120.16; 400/120.17; 156/384; 156/387

(58) Field of Search ..... 400/615.2, 55, 400/56, 57, 58, 59, 120.16, 120.17; 156/277, 384, 387

(56) References Cited

U.S. PATENT DOCUMENTS

| | | | | |
|---|---|---|---|---|
| 4,125,419 A | | 11/1978 | Hamisch, Jr. | 156/277 |
| 4,205,607 A | | 6/1980 | Sato | 101/291 |
| 4,206,703 A | | 6/1980 | Sato | 101/291 |
| 4,208,964 A | | 6/1980 | Sato | 101/291 |
| 4,350,554 A | | 9/1982 | Pabodie | 156/384 |
| 5,013,387 A | | 5/1991 | Goodwin et al. | 156/384 |
| 5,541,635 A | * | 7/1996 | Wills et al. | 347/197 |
| 5,804,023 A | | 9/1998 | Carpenter et al. | 156/261 |
| 5,882,126 A | * | 3/1999 | Bowling | 400/55 |
| 6,182,730 B1 | * | 2/2001 | Muir | 156/387 |

* cited by examiner

*Primary Examiner*—John S. Hilten
*Assistant Examiner*—Minh Chau
(74) *Attorney, Agent, or Firm*—McGarry Bair LLP

(57) ABSTRACT

An improved a label application apparatus comprises a main housing having a print roller mounted thereto for rotation about a print roller axis. A supply reel is mounted to the main housing and has an indefinite length web with label material thereon. A printer including a printer housing and a print head is positioned in abutting relationship to the print roller, the printer housing being mounted to the main housing for pivotal movement about a printer axis. A spring is preferably mounted between the printer and the main housing and biasing the print head against the print roller. An improvement thereto that facilitates more reliable contact between the print head and the print roller comprises a pivot mounting between the print head and the printer housing for mounting the print head for pivotal movement with respect to the printer housing about a print head axis, the print head axis being generally transverse to the printer axis. The print head is thereby adjustable about two axes with respect to the print roller to reduce misalignment between the print head and the print roller.

21 Claims, 2 Drawing Sheets

LABEL PRINTER/APPLICATOR WITH ADJUSTABLE, FLOATING PRINT HEAD

CROSS-REFERENCE TO RELATED APPLICATION

This application claims the benefit of U.S. Provisional Application Serial No. 60/128,896, filed Apr. 12, 1999.

BACKGROUND OF THE INVENTION

1. Field of the Invention

The invention relates to a label printing and applying printed labels to articles. In one of its aspects, the invention relates to a label printing apparatus with improved contact between a print head and a print roller. In another of its aspects, the invention relates to a label printing apparatus with a print head mounting for easily positioning the print head in a non-use cleaning position. In another of its aspects, the invention relates to a method of printing labels.

2. Description of the Related Art

In labeling objects such as packages, envelopes and the like, a label pasting and cutting apparatus is typically provided with a web of label material on a continuous backing web or the like. Alternatively, the web label material can be "linerless", i.e., without backing material. Typically, the label material web on the backing layer is advanced from a supply reel, and through a printer, which can provide desired indicia such as text and graphics onto the label, in addition to any indicia already pre-printed onto the label. If the label web has a backing web, the backing web is advanced over a label separator roller or "peeler" bar onto a take-up reel while the label web, separated from the backing web, is advanced to a cutter and label applicator. By means of the cutter, the printed label is cut from the continuous web of label material and is transferred to an object, such as package or envelope or the like, by the applicator.

Several problems have arisen in prior art label printing, cutting and applying devices. Many times a print head becomes misaligned with a print roller in the label printer. This misalignment can cause undesirable printing of labels such as reduced contact points resulting in light or nonexistent printing. Further, print heads often become dirty and must be either cleaned or replaced. Prior art printing devices are often difficult to access the print head for cleaning or replacing.

SUMMARY OF THE INVENTION

According to the invention, a label application apparatus comprising, a main housing having a print roller mounted thereto for rotation about a print roller axis, a supply reel mounted to the main housing and with an indefinite length web with label material thereon, and a printer including a printer housing and a print head positioned in abutting relationship to the print roller. The printer housing is preferably mounted to the main housing for pivotal movement about a printer axis. A spring is preferably mounted between the printer and the main housing and biasing the print head against the print roller.

A pivot mounting between the print head and the printer housing mounts the print head for pivotal movement with respect to the printer housing about a print head axis for improved contact between the print head and print roller. The print head axis is preferably generally transverse to the printer axis. The print head is thereby adjustable about two axes with respect to the print roller to reduce misalignment between the print head and the print roller.

The pivot mounting can comprise a bearing on one of the print head and the printer housing. The pivot mounting can further comprise an elongated rod mounted to the other of the print head and the printer housing. The bearing can receive an end of the elongated rod. The print head axis can be generally perpendicular to the printer axis. The print head axis can also be generally perpendicular to the print roller axis.

A retainer can be provided thereon for releasably securing the print head in a service location spaced from the print roller for servicing the label application apparatus. The retainer can be movably mounted to the main housing so that the printer housing has unobstructed movement with respect to the main housing to and from the service location when the retainer is in a retracted position. The retainer can comprise at least one movable pin movably mounted to the main housing between a retracted and an extended position.

An applicator can be mounted to the main housing adjacent to the printer for applying a label to an object such as a package or a box. A feed mechanism can be provided thereon for feeding the continuous web of label material from the supply reel to the printer and applicator.

BRIEF DESCRIPTION OF THE DRAWINGS

The invention will now be described with reference to the drawings in which.

DESCRIPTION OF THE PREFERRED EMBODIMENT

Figure 1:
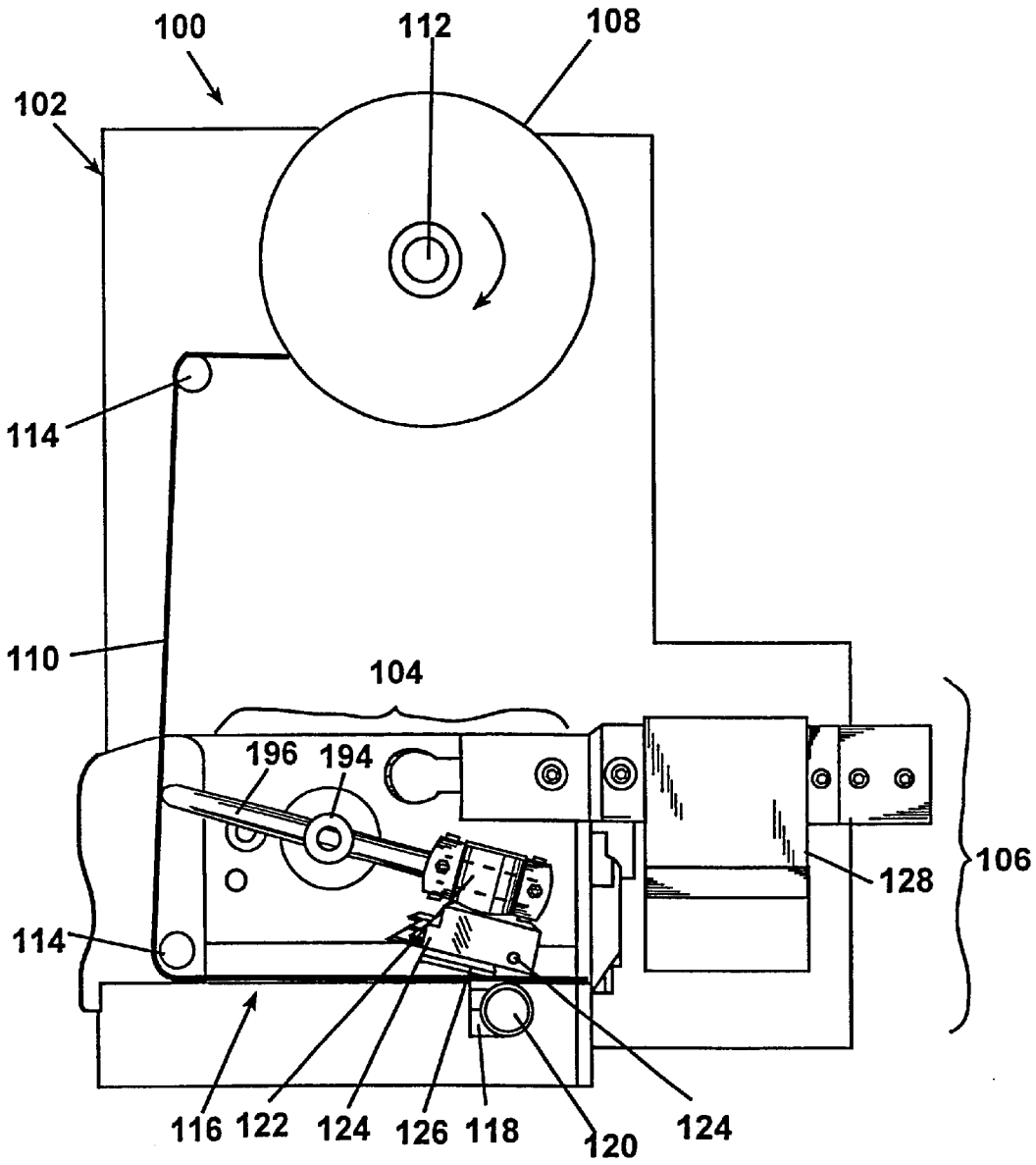
FIG. 1 is a front elevational view of a label printer with an adjustable, floating print head according to the invention and comprising an applicator with a vacuum head interconnected to a source of vacuum (V) and pressurized air (C) via a shuttle valve.

Referring now to the drawings and to FIG. 1 in particular, a label printer/applicator 100 is shown comprising a housing 102 which mounts a printer 104 and an applicator 106.

The housing 102 rotatably mounts a supply reel 108. The supply reel 108 carries a wound length of a continuous web of label material 110 which is often applied to a backing material (not shown). In the description provided herein, the printer/applicator 100 is shown operating with a "linerless" label web 110, although it can be plainly seen that an alternative label web 110 having a backing material can be used without departing from the scope of this invention.

The supply reel 108 is rotatably mounted on a support axle 112 which, in turn, is mounted to the housing 102. One or more slack rollers 114 can be rotatably mounted to the housing 102 for guiding a tensioned length of the label web 110 toward the printer 104.

The housing 102 has a printer platform 116 adapted to receive the label web 110 from the supply reel 108 located adjacent a lower portion of the housing 102 which has a recess 118. A print roller 120 is rotatably mounted to the housing 102 within the recess 118. The print roller 120 is preferably imparted with rotational motion by a conventional motor (not shown) which is mounted to the housing 102. The print roller 120 preferably has an outer diameter sized with the recess 118 so that an outer surface of the print roller 120 is generally flush with an outer surface of the printer platform 116. It has also been found that the print roller 120 can extend beyond the recess 118 a small amount to allow for abutment of the label material 110 passing over the recess 118.

The printer 104 comprises a printer housing 122 which has a lower portion 124 provided with a conventional print head 126. The print head 126 can be any conventional print head from the many known in the art such as a dot matrix, thermal transfer, ink jet, etc. It will be understood that the print head 126 is interconnected to an information store (not shown) which provides proper instructions to the print head 126. The printer housing 122 is mounted to the housing 102 by a shaft 196 mounted to a sleeve 194 rotatably mounted to the housing 102.

The applicator 106 is mounted to the housing 102 downstream of the printer 104 and generally comprises a head 128 which is adapted to receive a length of printed label web 110 from the printer 104, retain the length of printed label web 110 while a label is severed from the remaining continuous length of label web 110 and apply the severed label to an object adjacent to the printer/applicator 110.

The printer/applicator 100 operates generally by providing the supply reel 108 with a length of label web 110. The label web 110 is trained over the slack rollers 114, onto the printer platform 116 and between the print roller 120 and the print head 126 where the label web 110 is printed with any desired indicia such as text and graphics. Rotation of the print roller 120 drives the label web 110 between the print head 126 and the print roller 120.

Figure 2:
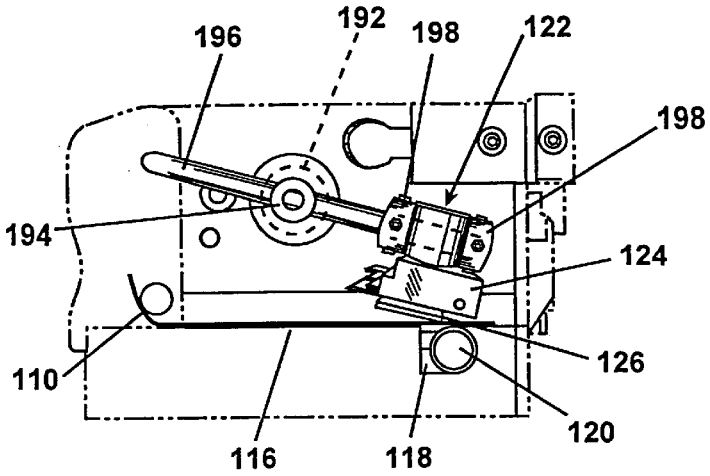
FIG. 2 is an enlarged front elevational view of the print head for the label printer of FIG. 1 showing the print head having a housing interconnected with a shaft via bearings so that the print head is rotatably mounted to the shaft whereby the print head abuts a print roller and is self-correcting for any misalignment of the print head relative to a print roller.

After the label web 110 is printed, the label web 110 is fed to the applicator 106 shown in FIGS. 1–2 where a discrete length of the label web 110 is severed from the continuous web as a label and applied to an object. If a label web 110 having backing material is used, the backing web (not shown in FIG. 1) is collected on a secondary accumulator such as a take-up reel as is well known in the art.

Figure 3:
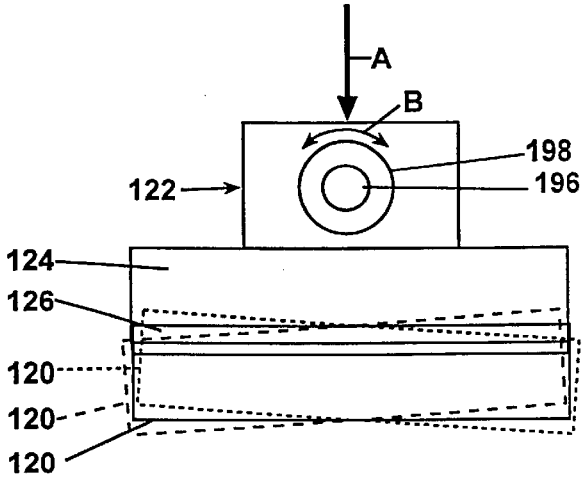
FIG. 3 is an end elevational view taken along lines 4—4 of FIG. 3 showing the print head and the print roller with label web therebetween whereby misaligned positions of the print roller and print head are shown in phantom outline form and the rotatable mounting of the print head on the shaft corrects for any misalignment.

Turning to FIG. 1 and to FIG. 3 in particular, the print head 126 of the printer 104 is preferably biased against the print roller 120 to ensure the highest quality printing onto the label material 110. This is especially true if the print head 126 is a dot matrix or a thermal transfer or other type of known print head where increased pressure of the print head against the label material results in an increase in print quality. The biasing of the print head 126 is accomplished by a torsional spring 192 which biases a rotatable sleeve 194 in a clockwise manner in the orientation shown in FIGS. 1 and 3 so that the shaft 196 movably mounted to the sleeve 194 is biased in a clockwise fashion as well.

This rotational bias serves to urge the print head 126 against the print roller 120 and against any label web 110 located therebetween. However, this bias is typically not sufficient to ensure a consistent engagement of the print head 126 against the print roller 120. The print roller 120 and the print head 126 can often become misaligned during the rigors of repeated use—and can often be misaligned from the first use of the apparatus 100 due to a manufacturing flaw wherein the print roller 120 was installed in a misaligned fashion to the housing 102. Therefore, it is an important feature of this invention that the printer 104 has a self-correction feature whereby misalignment of the print head 126 and the print roller 120 is corrected because the print head 126 is rotatably mounted along an axis of the same direction as the advancing label material 110 (and the shaft 196 in the apparatus shown in FIGS. 1 and 3).

The rotational mounting of the print head 126 relative to the shaft 196 is accomplished with a pair of bearings 198 on either end of the housing 122 as shown in FIG. 2. The housing 122 is thereby rotatably mounted about the shaft 196 on the bearings 198. The print head 126 is thereby automatically aligned along the print roller 120 by the combination of the rotational bias imparted by the spring 192 and the perpendicular rotational movement allowed by the journalling of the shaft 196 within the bearings 198.

FIG. 3 shows the print roller 120 in both aligned (solid lines) and pair of misaligned (phantom lines) positions. In any of these states of misalignment of the print head 126 with respect to the print roller 120, the spring 192 urges the print head 126 against the print roller—shown figuratively by arrow "A" in FIG. 3. Further, once contact is established between the print head 126 and the print roller 120, the rotational mounting of the shaft 196 within the bearings 198 (shown by arrow "B" in FIG. 3) allows for the print head 126 to fully contact the print roller 120 along its transverse length in any of the aligned and misaligned positions of FIG. 3. Thus, proper contact between the label web 110 located between the print head 126 and the print roller 120 is maintained. Print quality and performance by the print head 126 is increased and the printer/applicator 100 can be operated for longer periods of time before the print head 126 needs servicing or replacement.

Figure 4:
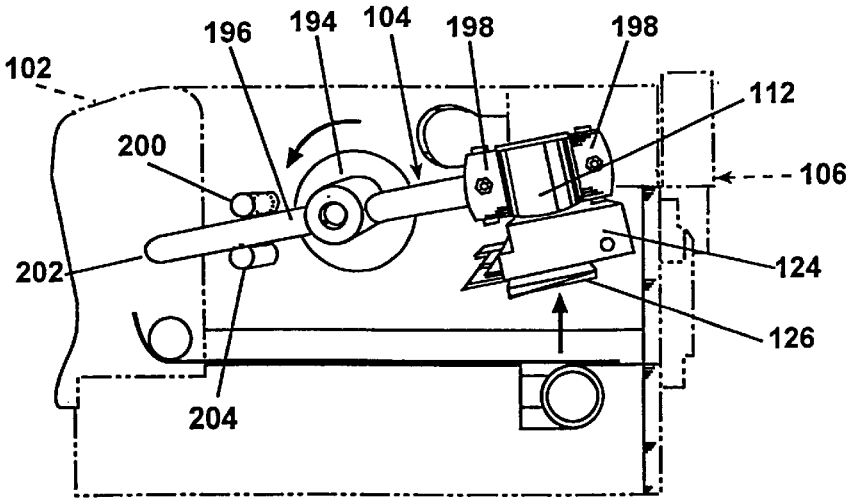
FIG. 4 is a fragmentary perspective view of the print head for the label printer of FIG. 1 and illustrating the print head rotated to and retained in a non-use position for servicing.

To the extent that the print head 126 eventually does need cleaning or replacing, it is also a feature of this apparatus 100 that the printer includes a convenient apparatus for positioning the print head 126 in a position for servicing. Thus, while FIG. 3 shows the print head 126 in contact with the print roller 120 in a printing position for marking the label web 110, FIG. 4 shows the printer housing 122 pivoted to a servicing position. The print head 126 has thereby been moved out of abutment with the print roller 120 and can be cleaned and/or serviced.

The printer housing 122 and, therefore, the print head 126 are retained in the servicing position by a first retaining pin 200 which is movably mounted to the housing 102 between an extended and a retracted position. The extended position of the first retaining pin 200 is shown in FIG. 4 in solid lines and the retracted position is shown in phantom lines.

The first retaining pin 200 is normally stored in the retracted position wherein the retaining pin 200 is removed from the path of rotational travel of a distal end 202 of the shaft 196. To position the printer 104 into the servicing position, the distal end 202 of the shaft 196 is urged by an operator in a counterclockwise direction until the distal end 202 of the shaft 196 is located below the vertical height of the retaining pin 200 and contacts the pin 204 which serves as a rotation limit for the shaft 196 and a lever to define a minimum range of motion for the shaft 196. The retaining pin 200 is then pulled by the operator to the extended position whereby the retaining pin 200 extends laterally from the housing 102 a greater extent than in the retracted position. The distal end 202 of the shaft 196 is then released so that the normal bias of the spring 192 attempts to urge the shaft 196 to rotate in a clockwise manner once again.

However, the retaining pin 200, now in the extended position, obstructs the arc of rotational travel of the shaft 196 so that the distal end 202 thereof is retained beneath the retaining pin 200.

The printer 104 is thereby maintained in the servicing position until the retaining pin 200 is returned to the retracted position toward the housing 102 so that the spring 192 again urges the print head 126 clockwise against the print roller 120 and normal operation of the printer/applicator 100 can resume.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure without departing from the spirit of the invention which is defined by the appended claims.

What is claimed is:

1. In a label application apparatus comprising:

a main housing having a print roller mounted thereto for rotation about a print roller axis;

a supply reel mounted to the main housing and having an indefinite length web with label material thereon;

a printer including a printer housing and a print head positioned in abutting relationship to the print roller, the printer housing being mounted to the main housing for pivotal movement about a printer axis;

a spring mounted between the printer and the main housing and biasing the print head against the print roller;

the improvement comprising:

a pivot mounting between the print head and the printer housing for mounting the print head for pivotal movement with respect to the printer housing about a print head axis, the print head axis being generally transverse to the printer axis, the print head is thereby automatically adjustable about two axes with respect to the print roller to reduce misalignment between the print head and the print roller.

2. The label application apparatus of claim 1 wherein the pivot mounting comprises a bearing on one of the print head and the printer housing.

3. The label application apparatus of claim 2 wherein the pivot mounting further comprises an elongated rod mounted to the other of the print head and the printer housing.

4. The label application apparatus of claim 3 wherein the bearing receives an end of the elongated rod.

5. The label application apparatus of claim 4 wherein the print head axis is generally perpendicular to the printer axis.

6. The label application apparatus of claim 5 wherein the print head axis is generally perpendicular to the print roller axis.

7. The label application apparatus of claim 6 and further comprising a retainer for releasably securing the print head in a service location spaced from the print roller for servicing the label application apparatus.

8. The label application apparatus of claim 7 wherein the retainer is movably mounted to the main housing so that the printer housing has unobstructed movement with respect to the main housing to and from the service location when the retainer is in a retracted position.

9. The label application apparatus of claim 8 wherein the retainer comprises at least one movable pin movably mounted to the main housing between a retracted and an extended position.

10. The label application apparatus of claim 9 and further comprising an applicator mounted to the main housing adjacent to the printer for applying a label to an object.

11. The label application apparatus of claim 10 and further comprising a feed mechanism for feeding the continuous web of label material from the supply reel to the printer and applicator.

12. The label application apparatus of claim 11 and further comprising a cutting mechanism associated with the applicator to cut the labels between the printer and the applicator.

13. The label application apparatus of claim 1 wherein the printer housing comprises an elongated rod, the print head further comprises a bearing, and a distal end of the elongated rod is pivotally received by the bearing.

14. The label application apparatus of claim 1 wherein the print head axis is generally perpendicular to the printer axis.

15. The label application apparatus of claim 1 wherein the print head axis is generally perpendicular to the print roller axis.

16. The label application apparatus of claim 1 and further comprising a retainer for releasably securing the print head in a service location spaced from the print roller for servicing the label application apparatus.

17. The label application apparatus of claim 16 wherein the retainer is movably mounted to the main housing so that the printer housing has unobstructed movement with respect to the main housing to and from the service location when the retainer is in a retracted position.

18. The label application apparatus of claim 17 wherein the retainer comprises at least one movable pin movably mounted to the main housing between a retracted and an extended position.

19. The label application apparatus of claim 1 and further comprising an applicator mounted to the main housing adjacent to the printer for applying a label to an object.

20. The label application apparatus of claim 1 and further comprising a feed mechanism for feeding the continuous web of label material from the supply reel to the printer and applicator.

21. The label application apparatus of claim 1 and further comprising a cutting mechanism associated with the applicator to cut the labels between the printer and the applicator.

* * * * *